US009082391B2

(12) United States Patent
Yermeche et al.

(10) Patent No.: US 9,082,391 B2
(45) Date of Patent: Jul. 14, 2015

(54) METHOD AND ARRANGEMENT FOR NOISE CANCELLATION IN A SPEECH ENCODER

(75) Inventors: Zohra Yermeche, Solna (SE); Anders Eriksson, Uppsala (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 411 days.

(21) Appl. No.: 13/640,564

(22) PCT Filed: Apr. 12, 2010

(86) PCT No.: PCT/SE2010/050393

§ 371 (c)(1),
(2), (4) Date: Oct. 11, 2012

(87) PCT Pub. No.: WO2011/129725

PCT Pub. Date: Oct. 20, 2011

(65) Prior Publication Data

US 2013/0034243 A1 Feb. 7, 2013

(51) Int. Cl.

| | |
|---|---|
| ***H04B 15/00*** | (2006.01) |
| ***G10K 11/178*** | (2006.01) |
| *G10L 21/0208* | (2013.01) |
| *G10L 21/0216* | (2013.01) |

(52) U.S. Cl.

CPC .... *G10K 11/1784* (2013.01); *G10K 2210/1081* (2013.01); *G10K 2210/3025* (2013.01); *G10L 21/0208* (2013.01); *G10L 2021/02165* (2013.01)

(58) Field of Classification Search

USPC ..... 379/406.01–406.16; 381/94.1–94.9

See application file for complete search history.

(56) References Cited

U.S. PATENT DOCUMENTS

| | | | | |
|---|---|---|---|---|
| 5,796,819 | A * | 8/1998 | Romesburg | 379/406.09 |
| 5,978,824 | A * | 11/1999 | Ikeda | 708/322 |
| 6,404,886 | B1 * | 6/2002 | Yoshida et al. | 379/406.01 |
| 6,639,986 | B2 * | 10/2003 | Kanamori et al. | 381/71.1 |
| 6,847,723 | B1 * | 1/2005 | Kiuchi et al. | 381/94.7 |
| 8,340,309 | B2 * | 12/2012 | Burnett et al. | 381/71.6 |
| 2003/0219113 | A1 | 11/2003 | Bershad et al. | |

(Continued)

FOREIGN PATENT DOCUMENTS

| | | | |
|---|---|---|---|
| CN | 1653713 | A | 8/2005 |
| CN | 101622669 | A | 1/2010 |
| EP | 0301627 | A1 | 2/1989 |

OTHER PUBLICATIONS

Office Action issued on Dec. 10, 2013 in corresponding Chinese application No. 201080066159.3, 2 pages.

*Primary Examiner* — Simon Sing
(74) *Attorney, Agent, or Firm* — Rothwell, Figg, Ernst & Manbeck, P.C.

(57) ABSTRACT

The present invention relates to a method and arrangement for an improved noise canceller in a speech encoder. Sound signals are captured at a primary microphone in conjunction with a reference microphone. An adaptive shadow filter is adapted to the correlation between the signals captured at the primary and reference microphones. Further, a diffuse-noise-field detector is introduced which detects the presence of diffuse noise. When the diffuse-noise-field detector detects diffuse noise, the filter coefficients of the adapted shadow filter is used by a primary filter to cancel the diffuse noise at the signal captured by the primary microphone. Since the filter coefficients of the adapted shadow filter only is used for cancellation when diffuse noise is solely detected, cancellation of the speech signal is avoided.

14 Claims, 8 Drawing Sheets

(56) References Cited

U.S. PATENT DOCUMENTS

| | | | | |
|---|---|---|---|---|
| 2004/0161101 | A1 | 8/2004 | Yiu et al. | |
| 2007/0273585 | A1 * | 11/2007 | Sarroukh et al. | 342/379 |
| 2008/0208538 | A1 | 8/2008 | Visser et al. | |
| 2009/0012786 | A1 * | 1/2009 | Zhang et al. | 704/233 |
| 2009/0022335 | A1 | 1/2009 | Konchitsky et al. | |
| 2009/0214054 | A1 * | 8/2009 | Fujii et al. | 381/94.1 |
| 2010/0098266 | A1 * | 4/2010 | Mukund et al. | 381/94.7 |

* cited by examiner

METHOD AND ARRANGEMENT FOR NOISE CANCELLATION IN A SPEECH ENCODER

CROSS-REFERENCE TO RELATED APPLICATION

This application is a 35 U.S.C. §371 National Phase Entry Application from PCT/SE2010/050393, filed Apr. 12, 2010, and designating the United States.

TECHNICAL FIELD

The present invention relates to a method and an arrangement for noise cancellation in a speech encoder, and in particular to low-frequency noise cancellation to improve the performance of the speech encoder.

BACKGROUND

Speech communication in wireless communication networks involves the transmission of a near-end speech signal to a far-end user. The problem is to estimate a clean speech signal from a captured noisy speech signal.

A mobile-phone can be equipped with a single or multiple microphones to capture the speech signal. Single-microphone solutions show room for improvement at low signal-to-noise ratio (SNR) with respect to speech intelligibility, which is most likely due to the low-frequency content of background noise. Dual-microphone solutions, implying availability of two distinct sensors to simultaneously capture the sound field, allow for the possible usage of spatial information and characteristics of sound sources such as the spatial coherence of the captured signals. These characteristics are related to the relative placement of the two microphones on the mobile-phone unit as well as the design and usage of the mobile-phone.

One way of implementing a dual-microphone solution is to use a reference microphone signal with low SNR combined to a primary microphone capturing the desired speech signal as well as the noise to achieve an adaptive noise cancellation. In other words, a far-mouth microphone, referred to as a reference microphone, is used in conjunction with a near-mouth microphone, referred to as a primary microphone. The signal captured by the reference-microphone is used by an adaptive filter to estimate the noise signal at the primary microphone. A subtractor produces an error signal from the difference between the primary-microphone signal and the estimated noise signal. The error signal and the reference signal are used to optimize the suppression of the correlated noise at the microphones.

Many background noise environments, such as a car cabin and an office, can be characterized by a diffuse noise field. A perfectly diffuse noise field is typically generated in an unbounded medium by distant, uncorrelated sources of random noise evenly distributed over all directions. Diffuse noise presents a high spatial coherence at the low frequencies and a low coherence at the high frequencies. Hence, the standard noise canceller presents the possibility of high noise reduction at low frequencies for far-field noise. However, the performance is dependent on the location of the microphones. Since the desired speech signal also may be captured by the reference microphone, although with relatively low power, a signal comprising the desired speech will be correlated at the two microphones and this signal may partially be cancelled by such method. Additionally, the captured speech will be present in the error signal used to adjust the speed of convergence of the adaptive filter, resulting in greater filter variations. When speech is present in the captured sound field the adaptation of the filter weights should be stalled.

Methods have previously been suggested to adjust the step size controlling the convergence speed of the adaptive filter based on the detection of near-end speech. For instance, in U.S. Pat. No. 5,953,380 the step size is adjusted based on an estimate of the SNR. The SNR estimation is performed using a secondary adaptive filter which uses the reference-microphone signal as an input to estimate the captured noise signal. The estimated noise signal is used to calculate the noise power and is also subtracted from the primary microphone signal to generate an estimate of the speech signal. The estimated speech signal is in turn used to update the secondary filter weights. An SNR estimate of the captured sound field is subsequently calculated based on the power estimates of the speech and the noise.

Another implementation of a noise canceller was suggested in U.S. Pat. No. 6,963,649, where the adaptation of the primary adaptive filter is done for each frequency bin individually based on the comparison of the subband signal power of the output from the noise canceller to a different threshold for each band. Also a one tap adaptive filter is working as a gain optimizing the suppression of the noise prior to the multi-tap subband adaptive filter.

The solution suggested in U.S. Pat. No. 5,953,380 does not take into consideration the presence of speech at the reference microphone input when the microphones are positioned in a close range such as in a mobile phone unit, which affects the SNR estimation.

The comparison of the filters output signal to a threshold in the frequency domain, as suggested in U.S. Pat. No. 6,963,649 is not a robust solution since the noise also can have high subband content, especially at low frequencies, and thus not be cancelled at those frequencies.

Also, in both U.S. Pat. No. 5,953,380 and in U.S. Pat. No. 6,963,649, the adaptation is stalled either in fullband or in individual subband when speech presence is detected, which means that the algorithm needs to re-converge each time the speech is interrupted.

SUMMARY

The object of the present invention is to achieve an improved noise canceller in a speech encoder.

This is achieved by capturing the sound signal with a primary microphone in conjunction with a reference microphone. An adaptive shadow filter is adapted to the correlation between the signals captured at the primary and reference microphones. Further, a diffuse-noise-field detector is introduced which detects the presence of diffuse noise. When the diffuse-noise-field detector detects diffuse noise, the filter coefficients of the adapted shadow filter are used by a primary filter to cancel the diffuse noise at the signal captured by the primary microphone. Since the filter coefficients of the adapted shadow filter are used for cancellation when only diffuse noise is detected, cancellation of the speech signal is avoided.

According to a first aspect of the present invention a method for an adaptive noise canceller associated with a primary microphone located close to the speaker's mouth and with a reference microphone located further away from the speaker's mouth than the primary microphone is provided. In the method, a first signal comprising speech and noise is captured by the primary microphone and a second signal comprising substantially noise is captured by the reference microphone. An adaptive shadow filter is adapted to an estimate of the correlation between the first signal and the second signal. It is then determined if the second signal substantially comprises diffuse noise by analyzing the frequency characteristics of the adapted adaptive shadow filter. If it is considered that the second signal substantially comprises diffuse noise the filter coefficients of the shadow filter are transferred to a primary filter to be used for cancelling the diffuse noise of the first input signal.

According to a second aspect of the present invention an adaptive noise canceller comprising a primary microphone located close to the speaker's mouth and a reference microphone located further away from the speaker's mouth than the primary microphone is provided. The primary microphone is configured to capture a first signal comprising speech and noise and the reference microphone is configured to capture a second signal ($y_r(t)$) comprising substantially noise by the reference microphone. The adaptive noise canceller further comprises an adaptive shadow filter configured to be adapted to an estimate of the correlation between the first signal and the second signal, and a diffuse-noise-field detector configured to determine if the second signal substantially comprises diffuse noise by analyzing the frequency characteristics of the adapted adaptive shadow filter. In addition, the adaptive noise canceller further comprises a primary filter configured to use the filter coefficients of the shadow filter for cancelling the diffuse noise of the first signal.

The suggested approach in the embodiments of the present invention involves a combination of two filters. The first filter acts as a shadow filter continuously adapting, to estimate the correlated signal at the two microphones, based on an error signal. The filter weights of the continuously adapting filter are transferred to the second filter when background (far-field) noise is considered to be solely present in the captured sound field. Thus an advantage with the embodiments of the present invention is that since the shadow filter is continuously adapting to the input data, it does not need to undergo an abrupt re-convergence each time the speech activity is interrupted.

Moreover, far-field noise has a diffuse coherence with highly correlated signals at the low frequencies and a low spatial correlation at high frequencies. When only diffuse noise is present in the captured sound field, the transfer function of the shadow filter presents low pass characteristics. The detection of a near-field signal presence in the captured sound field is done by detecting high magnitude content at the high frequencies for the transfer function of the shadow filter. This results in a further advantage of the embodiments of the present invention since such approach allows for the distinction between background noise and near-field speech based on their spatial distribution and independently on the spectral content of the active sound sources.

DETAILED DESCRIPTION

Figure 1:
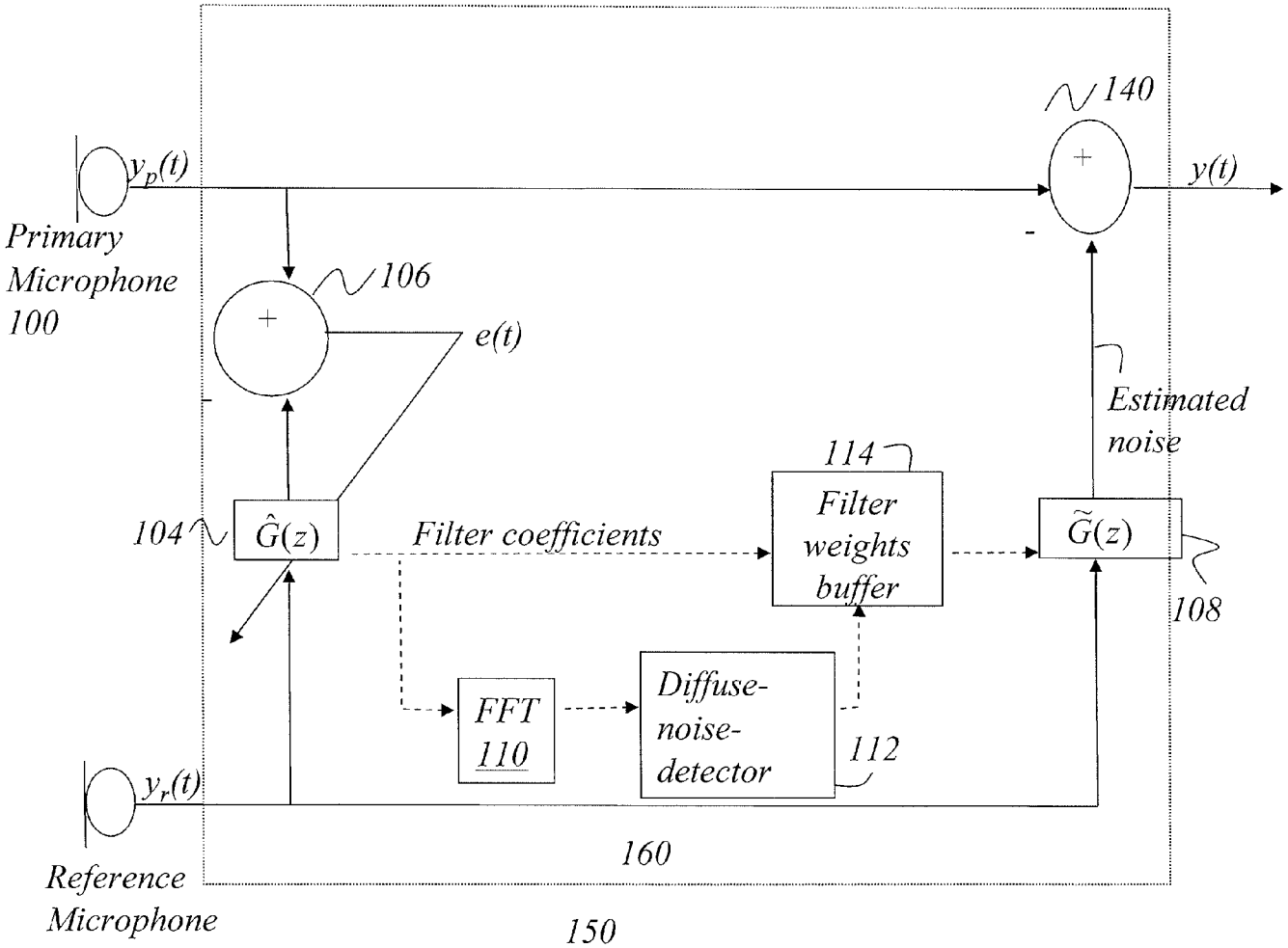
FIG. 1 shows an adaptive noise canceller according to embodiments of the present invention.

The present invention will be described more fully hereinafter with reference to the accompanying drawings, in which preferred embodiments of the invention are shown. The invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like reference signs refer to like elements.

Moreover, those skilled in the art will appreciate that the means and functions explained herein below may be implemented using software functioning in conjunction with a programmed microprocessor or general purpose computer, and/or using an application specific integrated circuit (ASIC). It will also be appreciated that while the current invention is primarily described in the form of methods and devices, the invention may also be embodied in a computer program product as well as a system comprising a computer processor and a memory coupled to the processor, wherein the memory is encoded with one or more programs that may perform the functions disclosed herein.

The embodiments of the present invention relate to a noise canceller as illustrated in FIG. 1. The adaptive noise canceller 150 comprises a primary microphone 100 located close to the speaker's mouth and a reference microphone 102 located further away from the speaker's mouth than the primary microphone 100. The reference microphone 102 may be faced in the opposite direction than the primary microphone 100. The primary microphone 100 is configured to capture a first signal $y_p(t)$ comprising speech and noise and the reference microphone 102 is configured to capture a second signal $y_r(t)$ comprising substantially noise. The adaptive noise canceller 150 further comprises an adaptive shadow filter 104 configured to be adapted to an estimate of the correlation between the first signal $y_p(t)$ and the second signal $y_r(t)$ and a diffuse-noise-field detector 112 configured to determine if the second signal substantially comprises diffuse noise by analyzing the frequency characteristics of the adapted adaptive shadow filter. Since the frequency characteristics are analyzed, the signal from the adaptive shadow filter is converted to the frequency domain by e.g. an FFT-operation 110. A primary filter 108 is included which is configured to use the filter coefficients of the shadow filter 104 for cancelling the diffuse noise of the first input signal $y_p(t)$. That can be done by a subtractor 140 subtracting the estimated noise from the primary-microphone signal referred to as the first signal, $y_p(t)$ to produce an output signal y(t) where the noise at the low frequencies is cancelled.

In order to adapt to the shadow filter to an estimate of the correlation between the first signal and the second signal, the adaptive shadow filter 104 is configured to filter the second signal to produce a filtered version of the second signal, and the noise canceller 150 further comprises a subtractor 106 configured to generate an error signal e(t) from a difference between the first signal and the filtered version of the second signal. The adaptive shadow filter is further adapted to update its filter coefficients by using the error signal e(t) and the second signal to adapt to an estimate of said part of the first signal which is correlated with the second signal.

Thus, the basic idea of the embodiments of the present invention is that the adaptive shadow filter continuously adapts to an estimate of the correlated signal at the two microphones, i.e. the estimate of the correlation between the first signal and the second signal, based on the reference-microphone signal and an error signal calculated as the difference between signal captured at the primary-microphone and the estimated correlated signal. This estimate is used for canceling diffuse noise from the signal captured by the primary microphone when diffuse noise is detected by the diffuse-noise-field detector.

Figure 2:
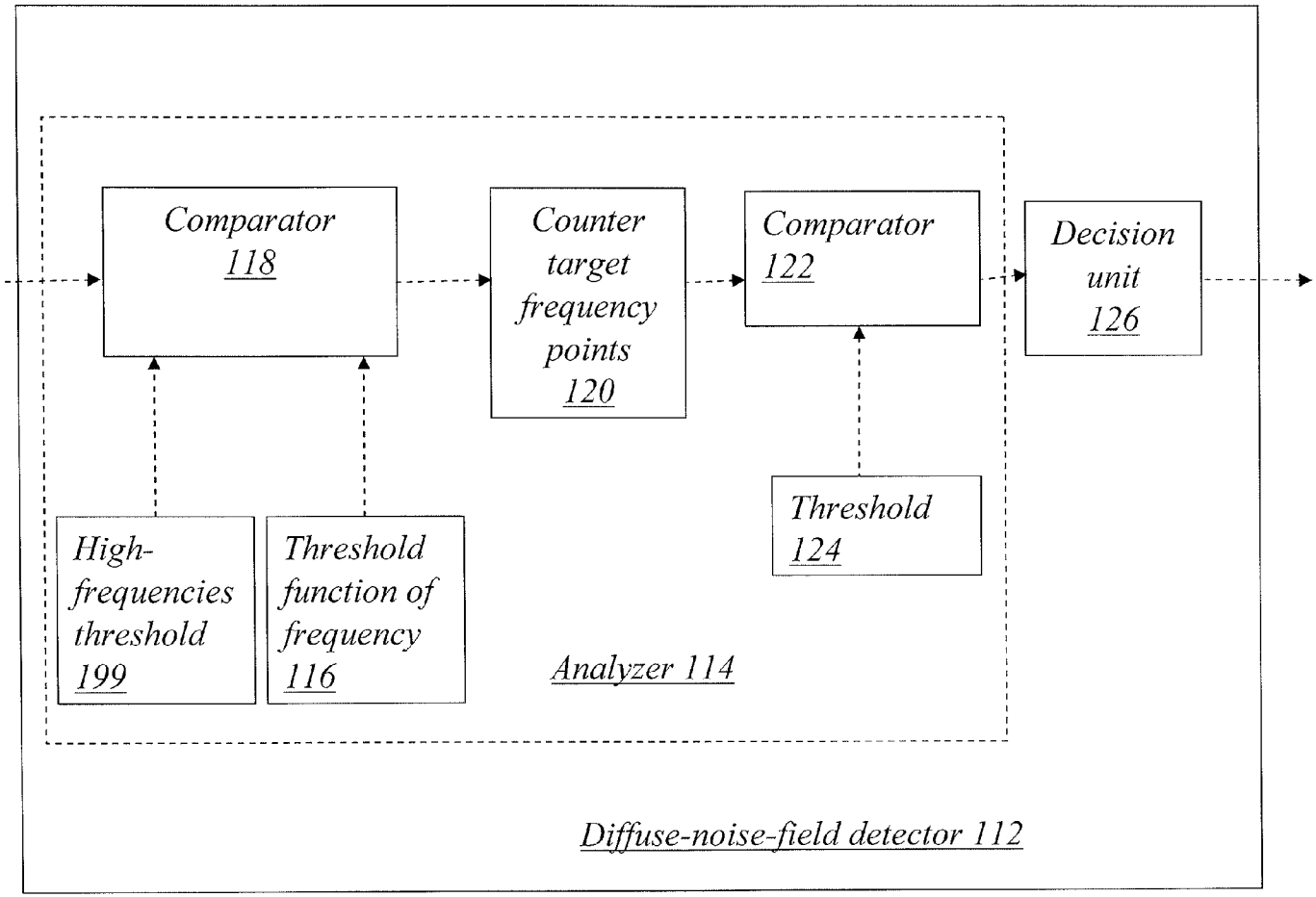
FIG. 2 shows the diffuse-noise-field detector according to embodiments of the present invention.

As stated above, the diffuse-noise-field detector 112 as further illustrated in FIG. 2 detects whether diffuse noise is solely present in the estimated signal. According to one embodiment the diffuse-noise-field detector comprises an analyzer 114 adapted to determine whether a predetermined part of the magnitude of the transfer function for the adapted adaptive shadow filter at high frequencies, i.e. frequencies above a first threshold 199, are above a second threshold 116. I.e. the first threshold 199 for the definition of the high frequencies is determined dependent on the distance between the primary microphone and the reference microphone.

Figure 3:
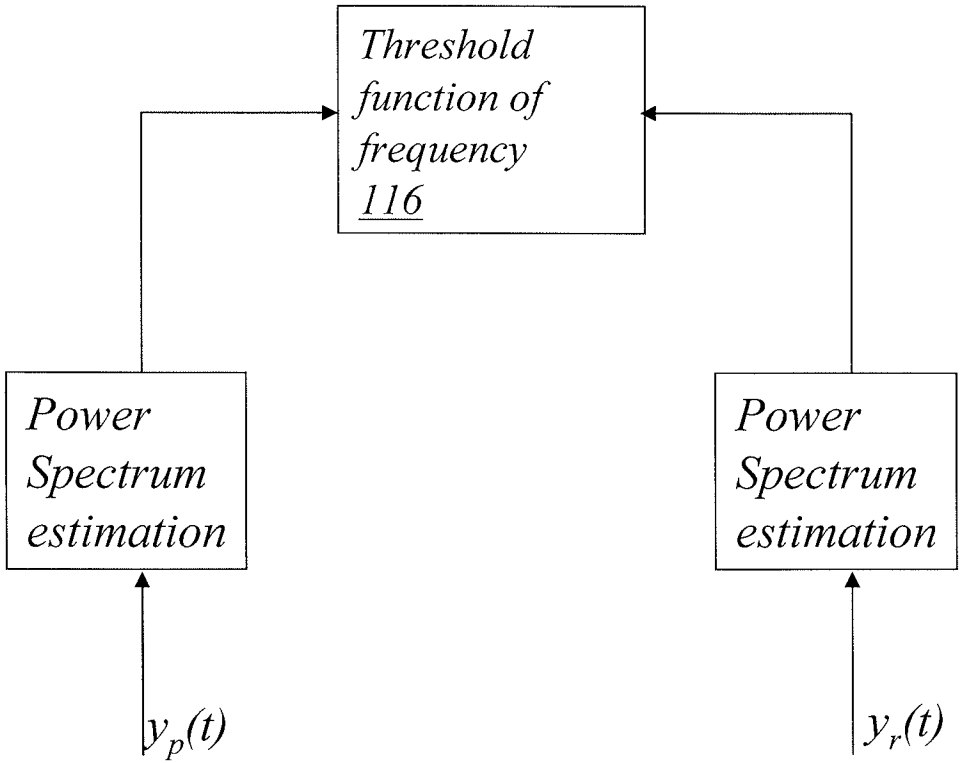
FIG. 3 shows an example of the threshold function of frequency can be implemented according to an embodiment of the present invention.

The second threshold 116 may either be a function of some parameters e.g. relating to power spectrum estimation of the input signals as exemplified in FIG. 3 or a fixed threshold. The analyzer is configured to determine that the second signal substantially comprises diffuse noise if the predetermined part of the magnitude of the transfer function for the adapted adaptive shadow filter at the high frequencies are below the second threshold, e.g. by comparing the magnitude of the transfer function at distinct frequency points. The predetermined part of the magnitude of the transfer function for the adapted adaptive shadow filter may be a predetermined number of frequency points above the first threshold 199. The frequency points above the first threshold are counted 120 and compared 122 to a third threshold. The third threshold for detecting diffuse noise is determined.

When diffuse-noise is detected, it is decided 126 to transfer the estimated filter weights of the shadow filter to the primary filter via a filter weights buffer which filters the reference-microphone signal such as to produce an estimate of the noise signal. When a near-end signal is detected, i.e. when diffuse noise is not solely detected, in the captured sound field by the analyzer, the previously transferred filter weights may be used to process the input signal.

To further describe the solution according to the embodiments of the present invention the two microphone inputs $y_p(t)$ and $y_r(t)$ as illustrated in FIG. 1 are considered:

$$y_p(t)=s_p(t)+n_p(t)+v_p(t)$$

$$y_r(t)=s_r(t)+n_r(t)+v_r(t) \tag{1}$$

where $y_p(t)$ is the input signal at the primary microphone and $y_r(t)$ is the input signal at the reference microphone, $s_p(t)$ and $s_r(t)$ are respectively the desired signal contributions at the primary and reference microphones, $n_p(t)$ and $n_r(t)$ are the coherent-noise components at the primary and the reference microphones, and $v_p(t)$ and $v_r(t)$ are the non-coherent-noise components at the primary and the reference microphones.

The objective of the adaptive noise canceller according to the embodiments of the present invention is to suppress the coherent-noise component from the primary microphone signal, $y_p(t)$, using the additional information acquired by the use of the secondary microphone signal, $y_r(t)$. A linear relation can be assumed between the coherent-noise components, as $$n_p(t)=G(z)\cdot n_r(t) \tag{2}$$

The objective can be reformulated as the estimation of the transfer function G(z) between the primary and reference microphones for the coherent part of the noise. The transfer function G(z) can be non-causal. Hence, the estimation of the transfer function denoted $\hat{G}(z)$ would be performed using a delayed version of the signal $n_p(t)$.

The output of the adaptive noise canceller according to the embodiments is given by $$\begin{aligned} e(t) &= y_p(t) - \hat{G}(z)\cdot y_r(t) \\ &= s_p(t) + n_p(t) + v_p(t) - \hat{G}(z)\cdot(s_r(t) + n_r(t) + v_r(t)) \\ &= s_p(t) + v_p(t) + \left(n_p(t) - \hat{G}(z)\cdot n_r(t)\right) - \\ &\quad \hat{G}(z)\cdot v_r(t) - \hat{G}(z)\cdot s_r(t) \end{aligned} \tag{3}$$

The estimation of the transfer function $\hat{G}(z)$ is obtained by minimizing the error signal, e(t). The contribution of the desired speech in the error signal will also be minimized since the speech signal is correlated at the two microphones. In other words, a distortion term $\hat{G}(z)*s_r(t)$ is introduced in the system's output when the desired speech signal is active, resulting in the cancellation of the desired signal. It follows that the estimation of the coherent-noise component at the two microphones should be performed during speech pauses.

A near-field signal e.g. generated by a speaker can be distinguished from background noise by its spatial coherence at two distinct points in space. The spatial coherence is calculated between the signals received at the primary and the reference microphone, respectively, as $$C_{y_p y_r}(f) = \frac{|\Phi_{y_p y_r}(f)|}{\left(\Phi_{y_p}(f)\cdot\Phi_{y_r}(f)\right)^{\frac{1}{2}}} \tag{4}$$

where $\Phi_{y_p y_r}(f)$, $\Phi_{y_p}(f)$ and $\Phi_{y_r}(f)$ are, respectively, the cross-power spectrum and power spectra of signals $y_p(t)$ and $y_r(t)$ at frequency f.

Figure 5:
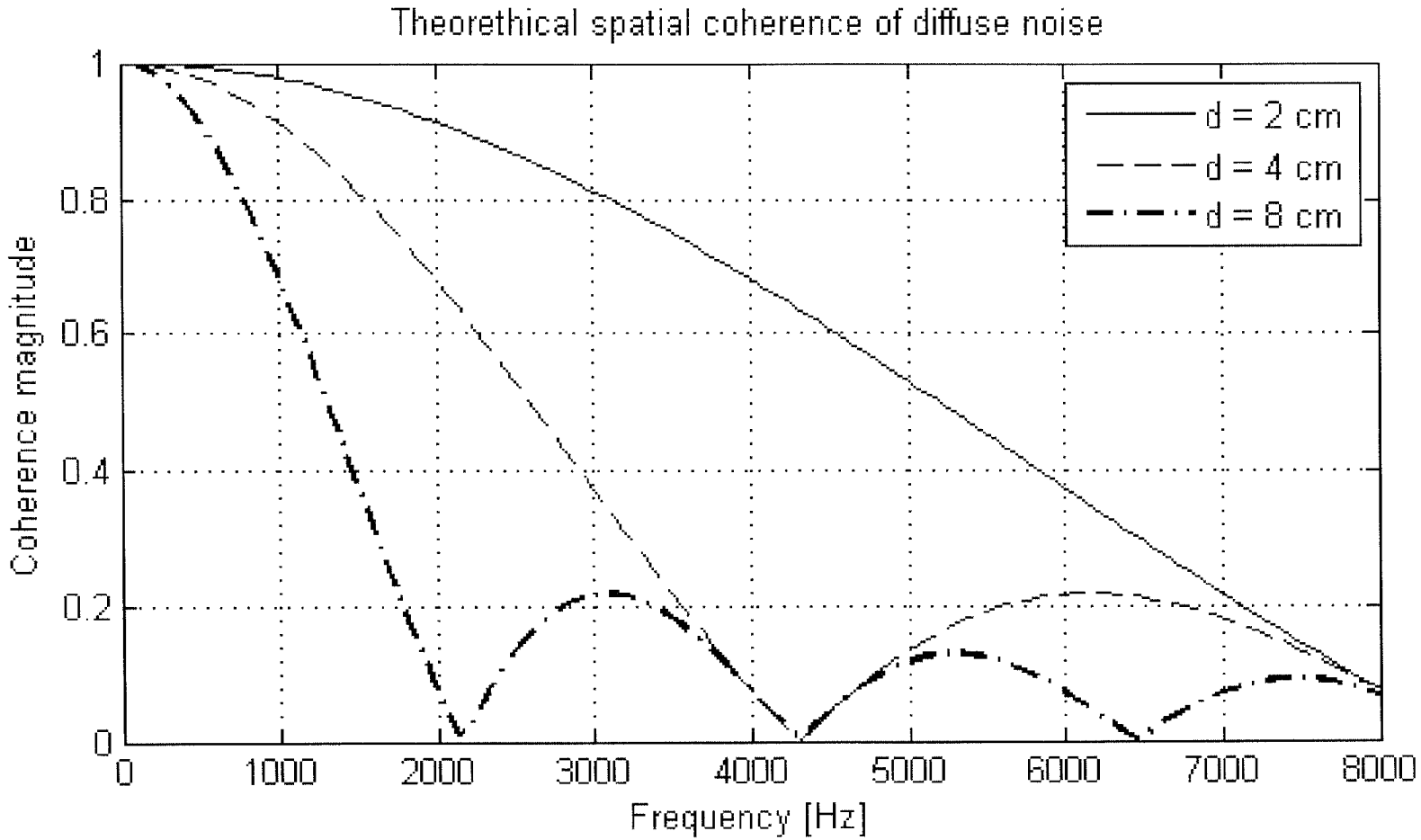
FIG. 5 shows spatial coherence of a perfectly diffuse noise field for different values of d.

In practice, near-field sounds in a non-reverberant environment have a high spatial coherence, while many noise environments such as a car cabin and an office can be characterized by a diffuse noise field, to some extend. The spatial coherence of a perfectly diffuse noise field is given by $$C_{y_p y_r}(f) = \frac{\sin\left(\frac{2\pi f d}{c}\right)}{\left(\frac{2\pi f d}{c}\right)} \tag{5}$$

where d is the inter-sensor distance, i.e. the distance between the primary microphone and the reference microphone and $c \approx 344$ m/s, is the speed of sound. The spatial coherence of a perfectly diffuse noise field is given in FIG. 5 for different values of d. Diffuse noise is characterized by a high spatial coherence at low frequencies and a low coherence at higher frequencies, while its envelope depends on the inter-microphone distance as depicted in FIG. 5. Given the diffuse nature of background-noise fields the noise component for the low frequencies is highly correlated at the two microphones, typically for frequencies $f<f_d$, where $f_d$ decreases with the distance between the primary and reference microphones denoted with d.

The adaptive shadow filter 104 in FIG. 1 is used to estimate the signal component correlated at the two microphones as described above. The output of the shadow filter 104 is subtracted from the primary microphone signal $y_p(t)$ to generate an error signal e(t) following $$\begin{aligned} e(t) &= y_p(t) - \hat{G}(z)\cdot y_r(t) \\ &= y_p(t) - \sum_{k=0}^{L-1} \hat{g}_k(t)\cdot y_r(t-k) \\ &= y_p(t) - \hat{G}_t^T \cdot Y_r(t) \end{aligned} \tag{6}$$

where $\hat{G}_t=[\hat{g}_1(t),\hat{g}_2(t), \ldots, \hat{g}_L(t)]^T$ is the estimated impulse response, the operator $[.]^T$ is the vector transpose, L is the filter length and the input data vector for the reference microphone is given by $Y_r(t)=[y_r(t), y_r(t-1), y_r(t-2), \ldots, y_r(t-L+1)]^T$.

The filter weights are generated in response to the reference noise signal and a difference signal output from the subtractor 106. A linear noise canceller of the embodiments of the present invention can be implemented using for example the block normalized least mean square (NLMS) structure. The update of the vector of filter weights, $\hat{G}_t$, is done every L:th sample using the following recursive approach $$\hat{G}_{t+L} = \hat{G}_t + \frac{\mu}{L}\sum_{k=0}^{L-1} \frac{e(t+k)\cdot Y_r(t+k)}{\|Y_r(t+k)\|^2} \tag{7}$$

where μ is a predefined adaptation step size.

An FFT 110 is applied to the estimated impulse response to obtain the transfer function of the adaptive filter.

$$\hat{G}(f)=FFT\{\hat{G}_t\} \tag{8}$$

The function of the diffuse-noise-field detector 112 relies on the evaluation of the transfer function's characteristics as a function of frequency.

The magnitude of $\hat{G}(f)$ at the high frequencies is compared to the magnitude of the expected filter, $G_{dif}(f)$, when a diffuse sound field is impinging on the dual microphones with power spectra $\Phi_{y_p}(f)$ and $\Phi_{y_r}(f)$, for each new block of L data.

The relationship between the input and output signals of the shadow filter 104 is given by the following equation $$\Phi_{y_{out}}(f)=\Phi_{y_r}(f)\cdot|\hat{G}(f)|^2 \tag{9}$$

where $\Phi_{y_{out}}(f)$ is the power spectrum of the shadow filter output $y_{out}(t)$.

On the other hand, as described in J. S. Bendat and A. G. Piersol, "Engineering Applications of Correlation and Spectral Analysis", chapter 3, pages 64-67, Wiley Interscience, 1993:

$$\Phi_{y_{out}}(f)=C_{y_p y_r}{}^2(f)\cdot\Phi_{y_p}(f) \tag{10}$$

From equations (5), (9) and (10), an estimation of the transfer function for the shadow filter 104, when a perfectly diffuse noise field is impinging on the dual microphones, is given by $$|G_{dif}(f)|^2 = \left(\frac{\sin\left(\frac{2\pi fd}{c}\right)}{\left(\frac{2\pi fd}{c}\right)}\right)^2 \cdot \frac{\Phi_{y_p}(f)}{\Phi_{y_r}(f)} \tag{11}$$

According to one embodiment, a threshold $H_{dif}(f)$ which also is referred to as the second threshold 116 may be a predetermined fixed threshold.

One alternative design for the diffuse-noise-field detection structure related to the determination of the second threshold 116 is depicted in FIG. 3. A frequency-dependent magnitude first threshold $H_{dif}(f)$ is calculated such as to encompass for the variance in the measure of $G_{dif}(f)$. For instance $H_{dif}(f)$ can be obtained as $$H_{dif}^2(f)=|G_{dif}(f)|^2+\mathrm{var}\{|G_{dif}(f)|\} \tag{12}$$

where var{.} stands for the variance.

The diffuse-noise-field detector 112 comprises an analyzer 114 which further comprises a comparator 118 shown in FIG. 2, which is used to compare the magnitude of the estimated transfer function to the second threshold 116 which may be a threshold function for a range of high frequencies ($f_{min}<f\leq f_{max}$), where $f_{min}$ and $f_{max}$ may be chosen as frequencies above the first threshold 199, which are dependent on the inter-microphone spacing d and the sampling frequency, $$E(f)=|\hat{G}(f)|-H_{dif}(f) \text{ for } f_{min}<f\leq f_{max} \tag{13}$$

The analyzer 114 may further comprise a counter 120 for counting the number of frequency points with magnitude greater than the first threshold 199, where for each new block of L data the counter is set to zero, i.e. $N_{count}=0$, $$\text{for } f_{min}<f\leq f_{max}, \text{if } E(f)>0, N_{count}=N_{count}+1 \tag{14}$$

The counter output for each block of data may be compared by another comparator 122 to a third threshold $N_{corr}$ 124. A decision concerning the nature of the captured sound field may be issued as a flag by a decision unit 126. E.g., if the sound field is considered to be of diffuse nature, the flag is set to unity and if on the other hand a coherent sound source is active the flag is set to zero as illustrated below.

$$\begin{cases} \mathrm{flag}_{dif} = 1 & \text{if} \quad N_{count} \leq N_{corr} \\ \mathrm{flag}_{dif} = 0 & \text{otherwise} \end{cases} \tag{15}$$

Thus a decision is made on the transfer of the impulse response from the shadow filter to the primary filter by the decision unit 126. Otherwise, the previously applied coefficients may be applied to the new frame of data. The filter weights buffer is defined as $$\begin{cases} \tilde{G}_t = \hat{G}_t & \text{if} \quad \mathrm{flag}_{dif} = 1 \\ \tilde{G}_t = \tilde{G}_{t-L} & \text{if} \quad \mathrm{flag}_{dif} = 0 \end{cases} \tag{16}$$

The primary filter $\tilde{G}(z)$ 108 generates the estimated noise signal in response to the reference noise signal and the received filter coefficients. The estimated noise signal is subtracted by a subtractor 140 from the primary microphone signal $y_p(t)$ to generate the output y(t) with cancelled low frequency diffuse noise.

$$y(t)=y_p(t)-\tilde{G}(z)\cdot y_r(t)=y_p(t)-\tilde{G}_t^T\cdot Y_r(t) \tag{17}$$

Figure 6:
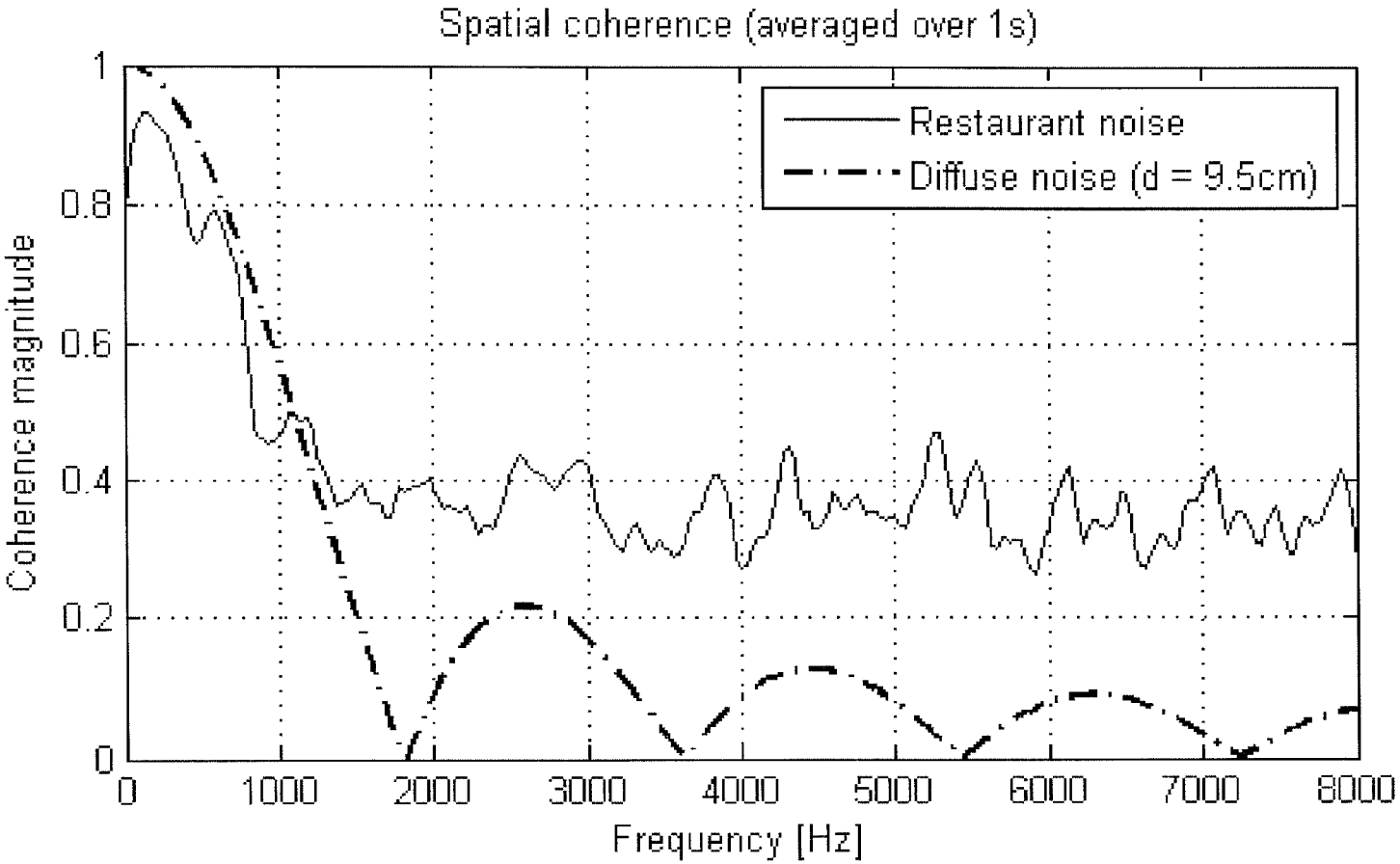
FIG. 6 shows the spatial coherence of data from dual-microphone recordings performed in a real-world environment and consisting of background noise in a restaurant according to embodiments of the present invention.
Figure 7:
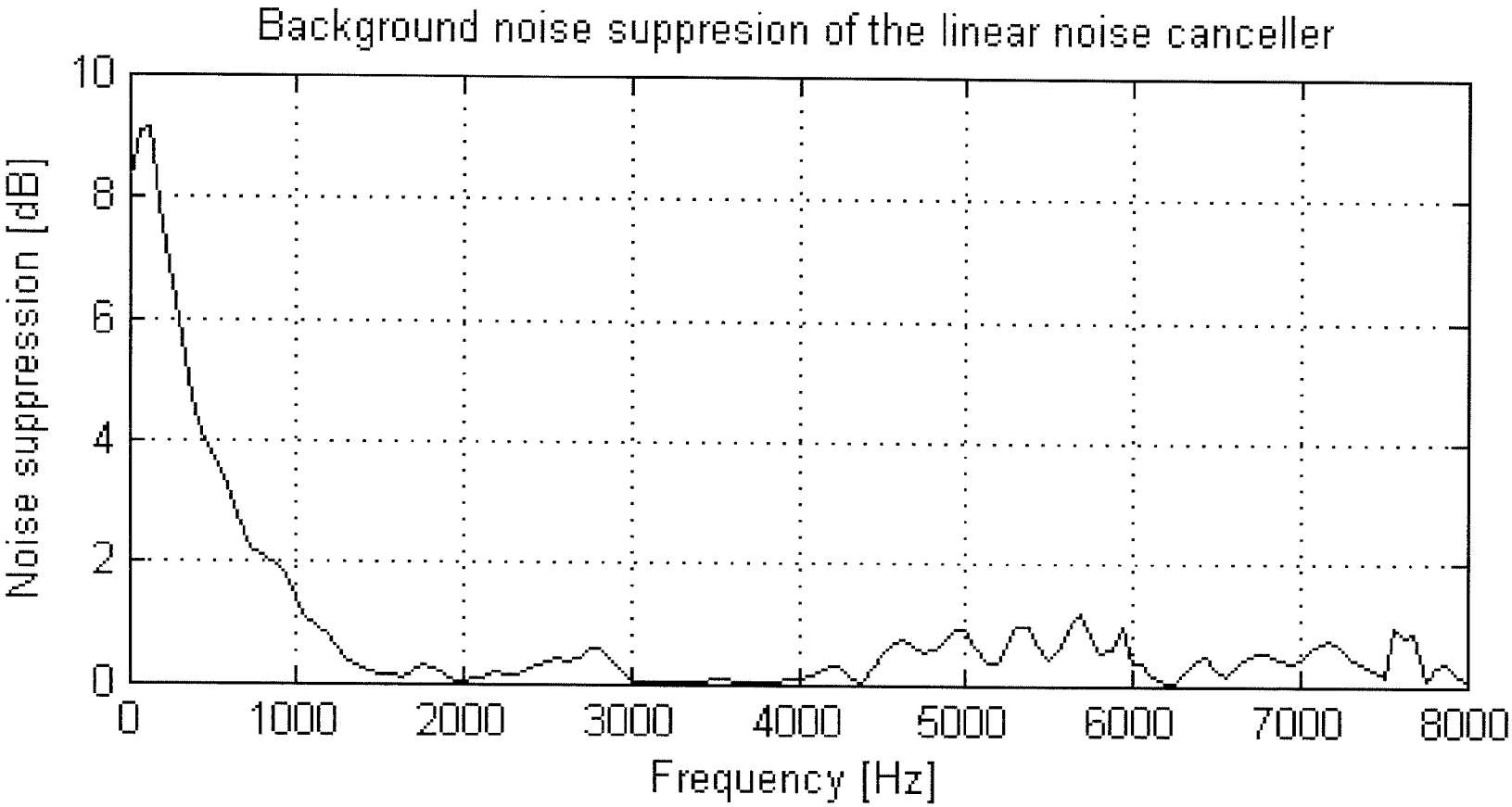
FIG. 7 shows an example of the performance of embodiments of the present invention obtained in a typical real-world scenario.

An example of the performance obtained in a typical real-world scenario is given in FIGS. 6 and 7. A dual-microphone recording of speech in restaurant noise acquired by a mobile phone in handheld position is processed by the linear noise canceller. The spatial coherence magnitude of the dual-microphone sound files when only background noise is present is plotted in FIG. 6 and the noise suppression obtained by the suggested algorithm as a function of frequency is given in FIG. 7. It can be seen that up to 9 dB noise suppression is obtained for the given data in the frequency range with corresponding high spatial coherence.

Figure 8:
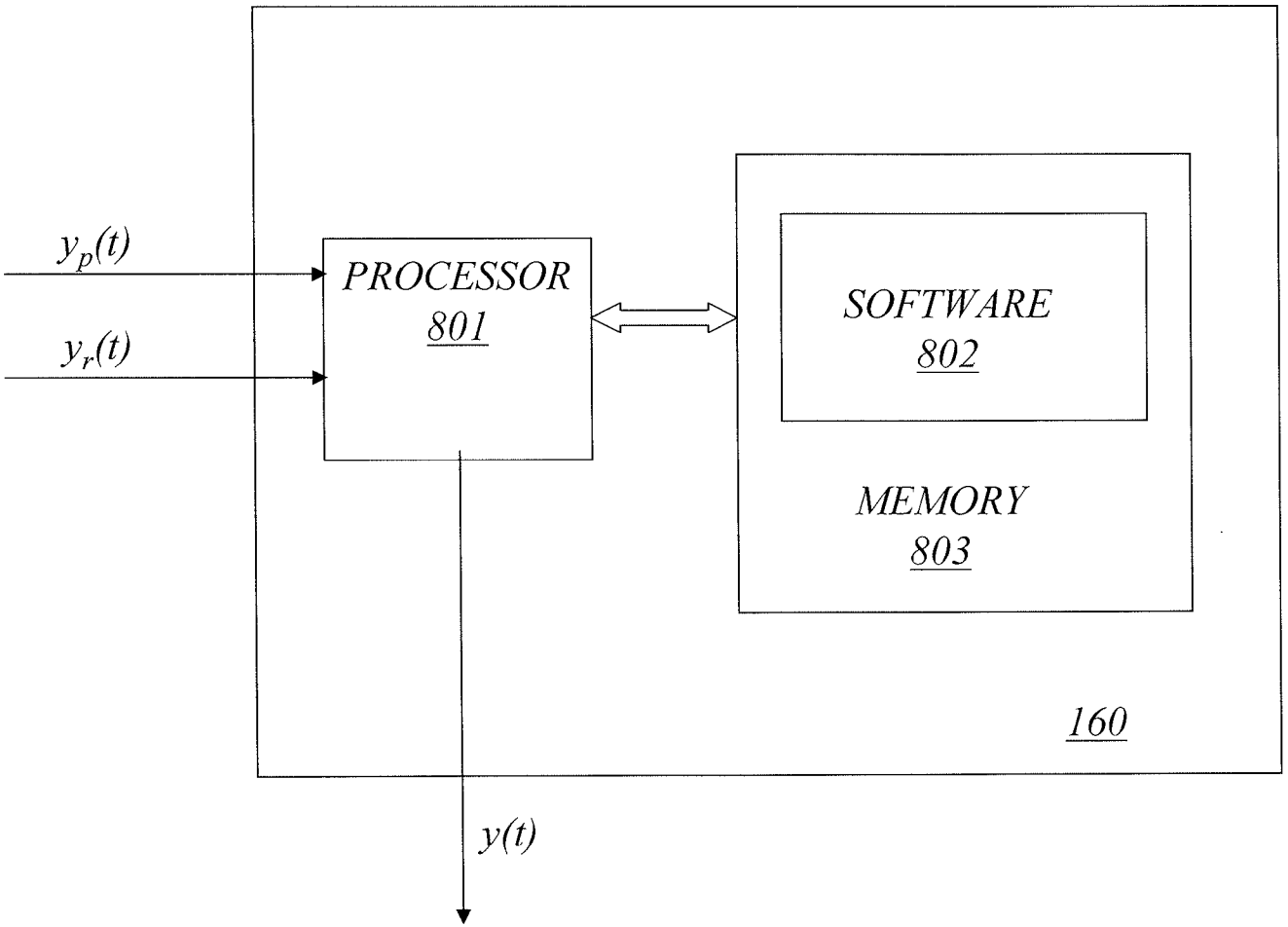
FIG. 8 shows an example implementation of the noise canceller according to embodiments of the present invention.

The functionalities within the box 160 of the adaptive noise canceller 150 of FIG. 1 can be implemented by a processor 801 connected to a memory 803 storing software code portions 802 as illustrated in FIG. 8. The processor runs the software code portions to achieve the functionalities of the noise canceller according to embodiments of the present invention.

Figure 4:
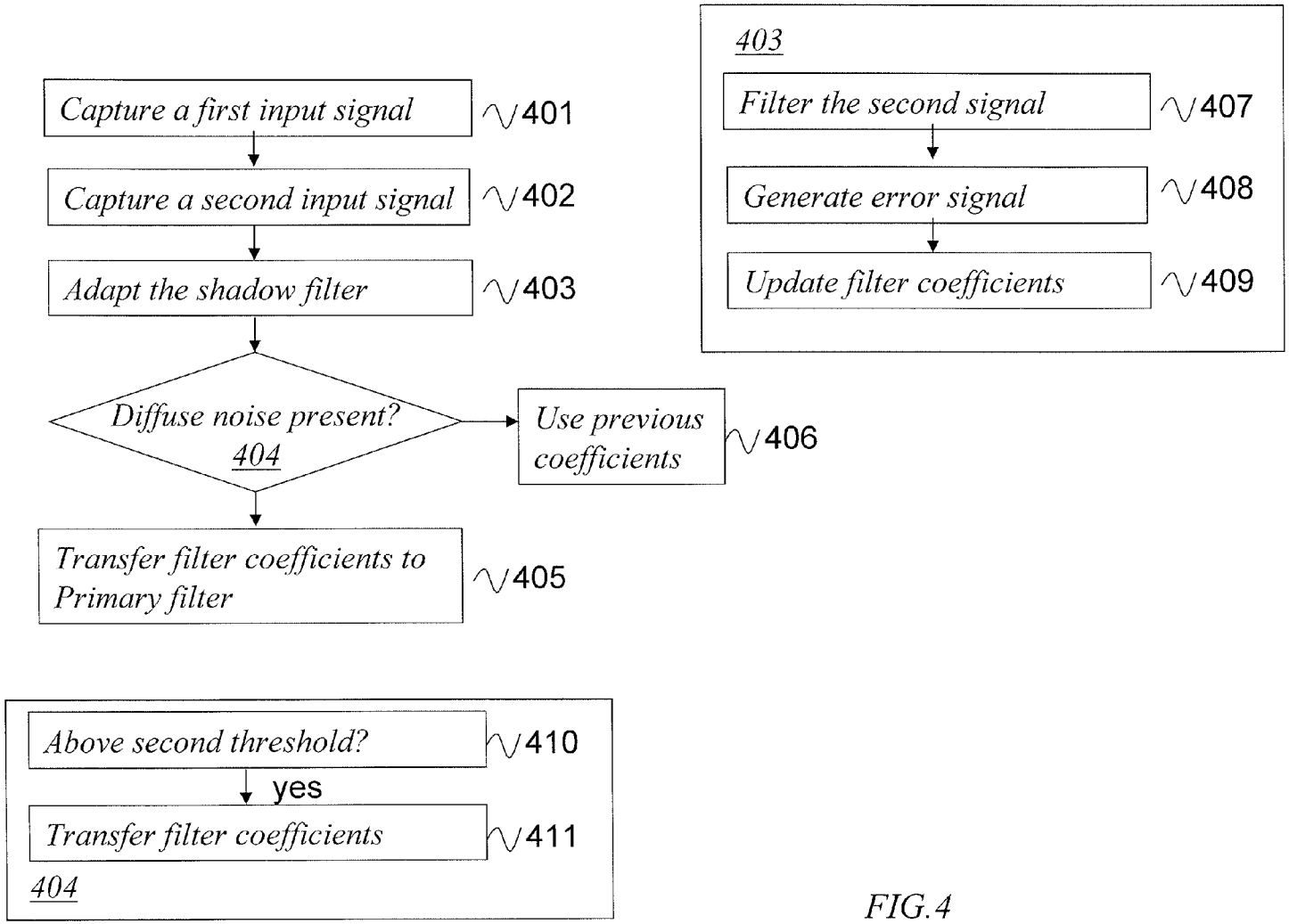
FIG. 4 is a flowchart of the method according to embodiments of the present invention.

To summarize, the embodiments of the present invention relates to a method. The method is illustrated in the flowchart of FIG. 4.

In the first steps 401, 402 a first signal comprising speech and noise is captured by the primary microphone, and a second signal comprising substantially noise is captured by the reference microphone. In the third step 403, an adaptive shadow filter is adapted to an estimate of the correlation between the first signal and the second signal. If it is determined 404 that the second signal is considered to substantially comprise diffuse noise by analyzing the frequency characteristics of the adapted adaptive shadow filter, the filter coefficients of the shadow filter are transferred 405 to a primary filter to be used for cancelling the diffuse noise of the first input signal.

According to an embodiment, the step 403 of adapting the adaptive shadow filter comprises the further steps of filtering 407 the second signal by the adaptive shadow filter to produce a filtered version of the second signal, generating 408 an error signal from a difference between the first signal and the filtered version of the second signal, and updating 409 the filter coefficients of the shadow filter by using the error signal and the second signal, i.e. the reference signal to adapt to the estimate of said part of the first signal which is correlated with the second signal.

According to a further embodiment, the frequency characteristics of the adapted adaptive shadow filter is analyzed by determining 410 whether a predetermined part of the magnitude of the transfer function for the adapted adaptive shadow filter at frequencies above a first threshold are below a second threshold, and determining 411 that the second signal substantially comprises diffuse noise if the magnitude of the transfer function for the adapted adaptive shadow filter at high frequencies, i.e. above the first threshold, are below the second threshold.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A method for an adaptive noise canceller associated with a primary microphone located close to a speaker's mouth and with a reference microphone located further away from the speaker's mouth than the primary microphone, the method comprising:

capturing a first signal comprising speech and noise by the primary microphone, capturing a second signal comprising substantially noise by the reference microphone, adapting an adaptive shadow filter to an estimate of the correlation between the first signal and the second signal, determining if the second signal substantially comprises diffuse noise by analyzing the frequency characteristics of the adapted adaptive shadow filter, and in response to determining that the second signal substantially comprises diffuse noise: transferring the filter coefficients of the shadow filter to a primary filter to be used for cancelling the diffuse noise of the first input signal.

2. The method according to claim 1, wherein the adaptive shadow filter is adapted to an estimate of the part of the first signal which is correlated with the second signal by:

filtering the second signal by the adaptive shadow filter to produce a filtered version of the second signal, generating an error signal from a difference between the first signal and the filtered version of the second signal, and updating the filter coefficients of the shadow filter by using the error signal and the second signal to adapt to an estimate of said part of the first signal which is correlated with the second signal.

3. The method according to claim 1, wherein the frequency characteristics of the adapted adaptive shadow filter is analyzed by:

determining whether a predetermined part of the magnitude of the transfer function for the adapted adaptive shadow filter at frequencies above a first threshold are below a second threshold, and determining that the second signal substantially comprises diffuse noise if the predetermined part of the magnitude of the transfer function for the adapted adaptive shadow filter at frequencies above the first threshold is considered to be below the second threshold.

4. The method according to claim 3, wherein the predetermined part of the magnitude of the transfer function for the adapted adaptive shadow filter is a predetermined number of frequency points above the first threshold.

5. The method according to claim 3, wherein the first threshold is dependent on the distance between the primary microphone and the reference microphone.

6. The method according to claim 3, wherein the second threshold is dependent on at least one of the first input signal and the second input signal.

7. The method according to claim 1, wherein if the second signal does not substantially comprise diffuse noise, using filter coefficients of the primary filter which are previously used.

8. An adaptive noise canceller comprising:

a primary microphone configured to capture a first signal ($y_p(t)$) comprising speech and noise;

a reference microphone configured to capture a second signal ($y_r(t)$) comprising substantially noise;

an adaptive shadow filter configured to be adapted to an estimate of the correlation between the first signal ($y_p(t)$) and the second signal ($y_r(t)$), a diffuse-noise-field detector configured to determine if the second signal ($y_r(t)$) substantially comprises diffuse noise by analyzing the frequency characteristics of the adapted adaptive shadow filter, and a primary filter configured to use filter coefficients of the adaptive shadow filter for cancelling the diffuse noise of the first signal ($y_p(t)$).

9. The adaptive noise canceller according to claim 8, wherein the adaptive shadow filter is configured to be adapted to the estimate of the correlation between the first signal ($y_p(t)$) and the second signal ($y_r(t)$) by being configured to filter the second signal to produce a filtered version of the second signal, the adaptive noise canceller comprises a subtractor configured to generate an error signal from a difference between the first signal and the filtered version of the second signal, and the adaptive shadow filter is adapted to update its filter coefficients by using the error signal and the second signal ($y_r(t)$) to adapt to an estimate of said part of the first signal which is correlated with the second signal.

10. The adaptive noise canceller according to claim 8, wherein the diffuse-noise-field detector comprises an analyzer adapted to determine whether a predetermined part of the magnitude of the transfer function for the adapted adaptive shadow filter at frequencies above a first threshold are above a second threshold, and the second signal substantially comprises diffuse noise if the magnitude of the transfer function for the adapted adaptive shadow filter at frequencies above the first threshold is considered to below the second threshold.

11. The adaptive noise canceller according to claim 10, wherein the predetermined part of the magnitude of the transfer function for the adapted adaptive shadow filter is a predetermined number of frequency points above the first threshold.

12. The adaptive noise canceller according to claim 10, wherein the first threshold is dependent on the distance between the primary microphone and the reference microphone.

13. The adaptive noise canceller according to claim 10, wherein the second threshold is dependent on at least one of the first signal $y_p(t)$ and the second signal $y_r(t)$.

14. The adaptive noise canceller according to claim 8, wherein the primary filter is configured to use filter coefficients of the primary filter which are previously used if the second signal $y_r(t)$ does not substantially comprise diffuse noise.

* * * * *